US007163127B2

(12) United States Patent
Seelhofer

(10) Patent No.: US 7,163,127 B2
(45) Date of Patent: Jan. 16, 2007

(54) TAMPER-PROOF HINGED CLOSURE FOR FILM-SEALED BOTTLES AND CONTAINERS FILLED WITH POURABLE CONTENTS

(75) Inventor: Fritz Seelhofer, Lindau (CH)

(73) Assignee: SIG Technology Ltd., Neuhausen am Rheinfall (CH)

( * ) Notice: Subject to any disclaimer, the term of this patent is extended or adjusted under 35 U.S.C. 154(b) by 0 days.

(21) Appl. No.: 10/533,741

(22) PCT Filed: Nov. 4, 2003

(86) PCT No.: PCT/CH03/00719

§ 371 (c)(1),
(2), (4) Date: Jun. 24, 2005

(87) PCT Pub. No.: WO2004/043821

PCT Pub. Date: May 27, 2004

(65) Prior Publication Data

US 2006/0049204 A1 Mar. 9, 2006

(30) Foreign Application Priority Data

Nov. 11, 2002 (CH) ..... 1891/02

(51) Int. Cl.
*B67D 5/00* (2006.01)

(52) U.S. Cl. ..... 222/83

(58) Field of Classification Search ..... 222/83
See application file for complete search history.

(56) References Cited

U.S. PATENT DOCUMENTS

| | | | | |
|---|---|---|---|---|
| 4,397,400 | A * | 8/1983 | Walter | 220/259.2 |
| 4,431,110 | A * | 2/1984 | Roth | 215/213 |
| 4,795,043 | A * | 1/1989 | Odet et al. | 222/83 |
| 4,869,399 | A | 9/1989 | Dubach | |
| 5,853,109 | A | 12/1998 | Elliott | |

* cited by examiner

*Primary Examiner*—Philippe Derakshani
(74) *Attorney, Agent, or Firm*—Edwin D. Schindler

(57) ABSTRACT

The guarantee hinge closure is envisaged for film-sealed bottles and containers of flowable contents. It comprises a cap-like lower part (1) with an inner thread (16) which is closed on its cap lid (5) with the exception of a pour-out spout (4) of less than half the diameter of the inner thread (16) of the cap lid (5). A lid cap (2) is integrally formed on this lower part (1) via a hinge (3), with a muff (7) formed on this lid cap which in the closure position embraces the pour-out spout (4). The cap lid (5) of the lower part (1) outside the pour-out spout (4) includes a piercing means (6) with a piercing pin (24). The piercing means (6) may be pushed from an upper initial position amid springing deformation into a lower end position. The lid cap (2) contains a push button (8) for actuating the piercing means (6). The push button (8) is connected to the lid cap (2) via material bridges (9) which act as break-off locations. On opening the closure for the first time the push button (8) remains clinging on the lower part (1) and with it therefore the piecing means (6) may be pressed downwards, whereupon the piercing spike (24) opens the sealing film.

7 Claims, 9 Drawing Sheets

Figure 1:
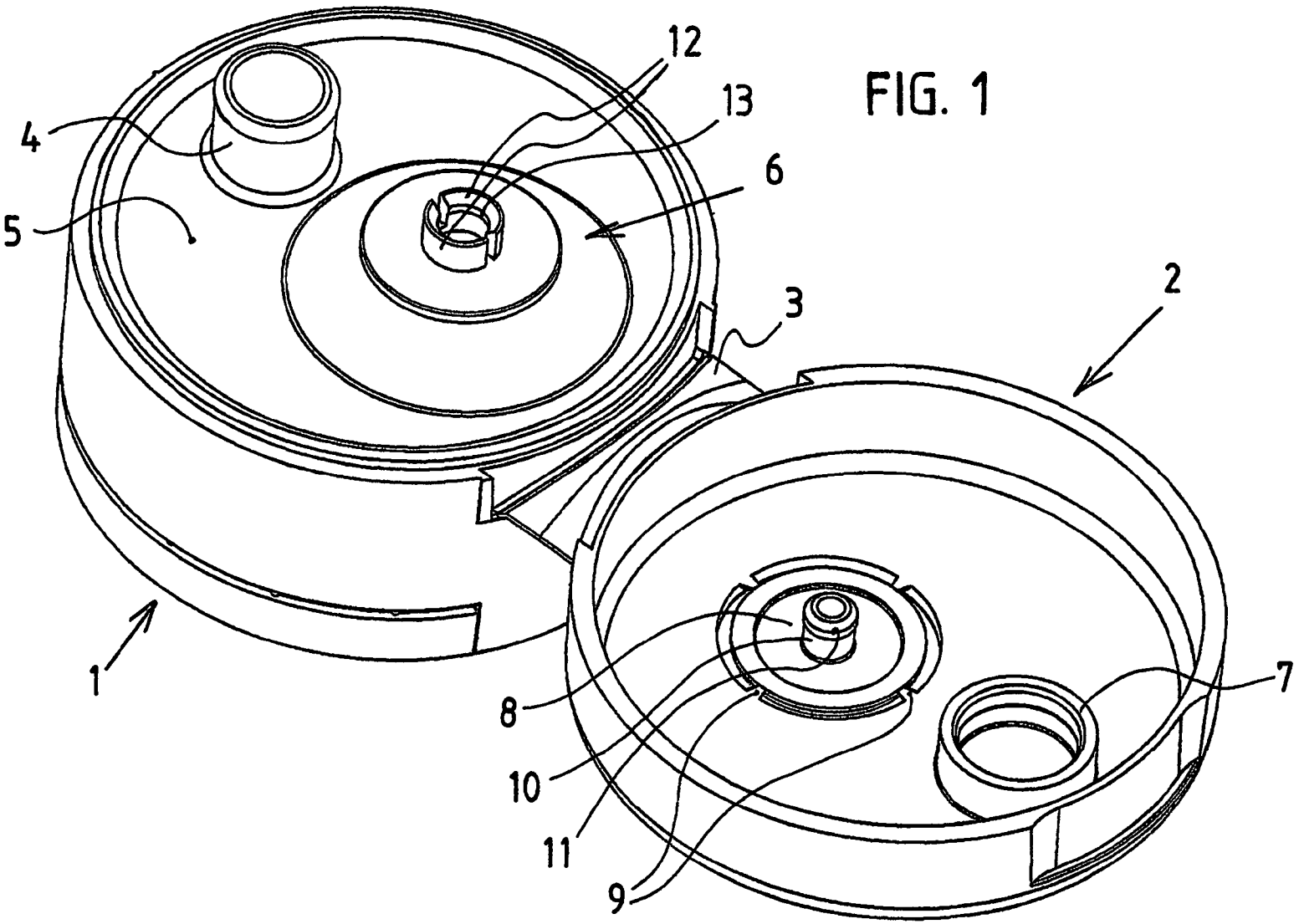

TAMPER-PROOF HINGED CLOSURE FOR FILM-SEALED BOTTLES AND CONTAINERS FILLED WITH POURABLE CONTENTS

BACKGROUND OF THE INVENTION

1. Technical Field of the Invention

This invention relates to a guarantee hinge closure, and specifically for bottles and containers which contain flowable media and whose pour-out spouts are closed with a film which is welded or bonded onto the edge of the pour-out spout. Ketchup bottles which comprise such pour-out spouts closed with a film are widespread and known to everybody. With the regard to the flowable contents however it need not be the case of foodstuffs. Such hinge closures could just as easily be applied to bottles for paints, chemicals, lubricants etc, above all for relatively viscous media which are to be poured out in a dosed manner. The bottle spouts of such a bottle, specifically such as of a ketchup bottle is provided with an outer thread onto which a plastic closure with a lid cap integrally formed thereon in a hinged manner is screwed. The plastic closure at the same time consists of a lower part which comprises an inner thread, and on its upper side closes the bottle opening with the exception of a relatively small pour-out spout which has a magnitude of about one fifth of the diameter of the bottle opening. A film hinge is arranged at the edge of this lower part via which a lid cap is integrally formed as one piece. The lid cap in its height is dimensioned such that in the condition when it is pivoted onto the lower part, it completely accommodates the pour-out spout within itself and thus closes it all around. A perpendicularly projecting muff is integrally formed on its inner side, which in the pivoted-closed condition encloses the pour-out spout. The pour-out spout may at its upper edge on the outer side form a slightly protruding bead which then fits into a corresponding recess in the inner side of the muff on the lid cap. By way of this a sealed closure of the pour-out spout is achieved and the lid cap in the closed, that is to say pivoted-closed position snaps on the lower part of the closure.

2. Description of the Prior Art

The filling of the bottle and of the container however is effected before such a hinge closure is screwed onto a threaded spout. Afterwards the bottle or the container is firstly sealed with a sealing film. With this film it is the case of an aluminium film or a plastic film which is bonded or welded onto the upper closure edge of the threaded spout. Afterwards the hinge closure is screwed on, and the bottle or the container reaches the customer in this form So that the customer may pour out the contents of the bottle or the container, firstly this film must be cut open, pierced, torn open, punched or cut through, or however it is completely removed. In many cases, to do this, firstly the lid cap on the hinge closure is flipped open and then with a sharp object, for example with a needle, point of a scissors, a sharp knife, a toothpick or a similar aid, the film is pierced through the pour-out spout and pushed downwards. In most cases however a clean pour-out hole does not arise. On the contrary, shreds of film project downwards. If for example ketchup is poured out through the pour-out spout then as a result of the consistency of this fluid some ketchup unavoidably remains clinging to these shreds. One may observe the same effect with other fluids having a similar consistency or viscosity. If then the bottle is then placed in its upright condition again, then this ketchup dries on the shreds and here forms a crust which grows somewhat with each renewed pouring-out until the pour out spout in the worst case is blocked. The correct opening of a hinge closure on a ketchup bottle or on another container with a hinge closure which is closed by film in this manner must therefore be effected such that firstly the plastic hinge closure is screwed loose from the bottle of container spout, and then completely removed from this. Then the film should be completely tom away from the upper edge of the pour-out spout. The films for this often comprise a tear tab. If one opens a such a hinge closure exactly in this manner, then its functioning is not inhibited and the contents may be poured out in a directed and clean manner. However, even if such a closure is operated in the correct manner, it does not satisfy all aspects.

On the closed closure for example one may not recognise whether is has already been opened once before or not, that is to say whether its lid cap has already been pivoted open once before or not. For this a separate guarantee strip would be required which would have to be removed before pivoting open the lid cap. Such a strip however is absent with many such hinge closures. One makes do with sticking a paper strip over the whole closure, whose two ends extend downwards onto the bottle neck. However a hinge closure which itself would form a guaranteed closure is demanded, and from which one would furthermore automatically be able to see if its lid cap has already been pivoted up once before or not, without a separate paper seal strip becoming necessary for this.

A second even more serious disadvantage for the described hinge closures lies in the fact that the clearing of the passage of the pour-out spout is not solved in a satisfactory manner. As mentioned, one either requires a sharp object which however anyway does not lead to a clean opening of the passage, or one must firstly unscrew the whole closure completely from the bottle spout, then tear away the film and afterwards screw the hinge closure back onto the bottle. This is an operation whose necessity is not immediately evident to the user of such a closure for the first time. It may be the reason why, to help, the film is often opened through the pour-out spout with a sharp object. The correct opening by way of the temporary complete removal of the hinge closure and a subsequent removal of the film and rescrewing the closure as a whole constitutes an effort which one wishes to eliminate, in order to render the closure more user-friendly.

SUMMARY OF THE INVENTION

It is therefore the object of the present invention to provide a hinge closure for film-sealed bottles and containers of flowable contents which overcomes the disadvantages which have been cited above. This hinge closure firstly should be a guarantee closure in the sense that the fact that it has been opened once before is easily recognisable on the closed closure. Secondly the hinge closure is to permit the film on the bottle or container spout, said film being arranged below the closure, to be opened in a perfect manner so that it is ensured that the contents may be poured out through the pour-out spout. The opening of the film at the same time should be accomplished without a removal of the closure. The hinge closure thus should be considerably more user-friendly than conventional solutions. At the same time however it should be able to be manufactured as one piece and in an inexpensive manner so that despite its technically improved characteristics, it may be manufactured just as economically or insignificantly more expensively than conventional hinge closures of this type.

This object is achieved by a guarantee hinge closure for film-sealed bottles and containers of flowable contents, with a cap-like lower part with an inner thread which on its cap lid is closed with the exception of a pour-out spout of less than half the diameter of the inner thread of the cap lid, as well as with a lid cap which is integrally formed in a hinged manner on this lower part, having an integrally formed muff on its inner side for encompassing the pour-out spout in the closure position, wherein the closure is characterised in that the cap lid of the lower part outside the pour-out spout includes a piercing means with a piercing spike arranged centrically to it, said piercing means being capable of being pushed from an upper initial position amid springing deformation into a lower end position, and the lid cap which belongs to this lower part in a hinged manner includes a push button for actuating the piercing means, said button being connected to this means via material bridges which are envisaged to act as break-off locations.

BRIEF DESCRIPTION OF THE DRAWING FIGURES

Figure 2:
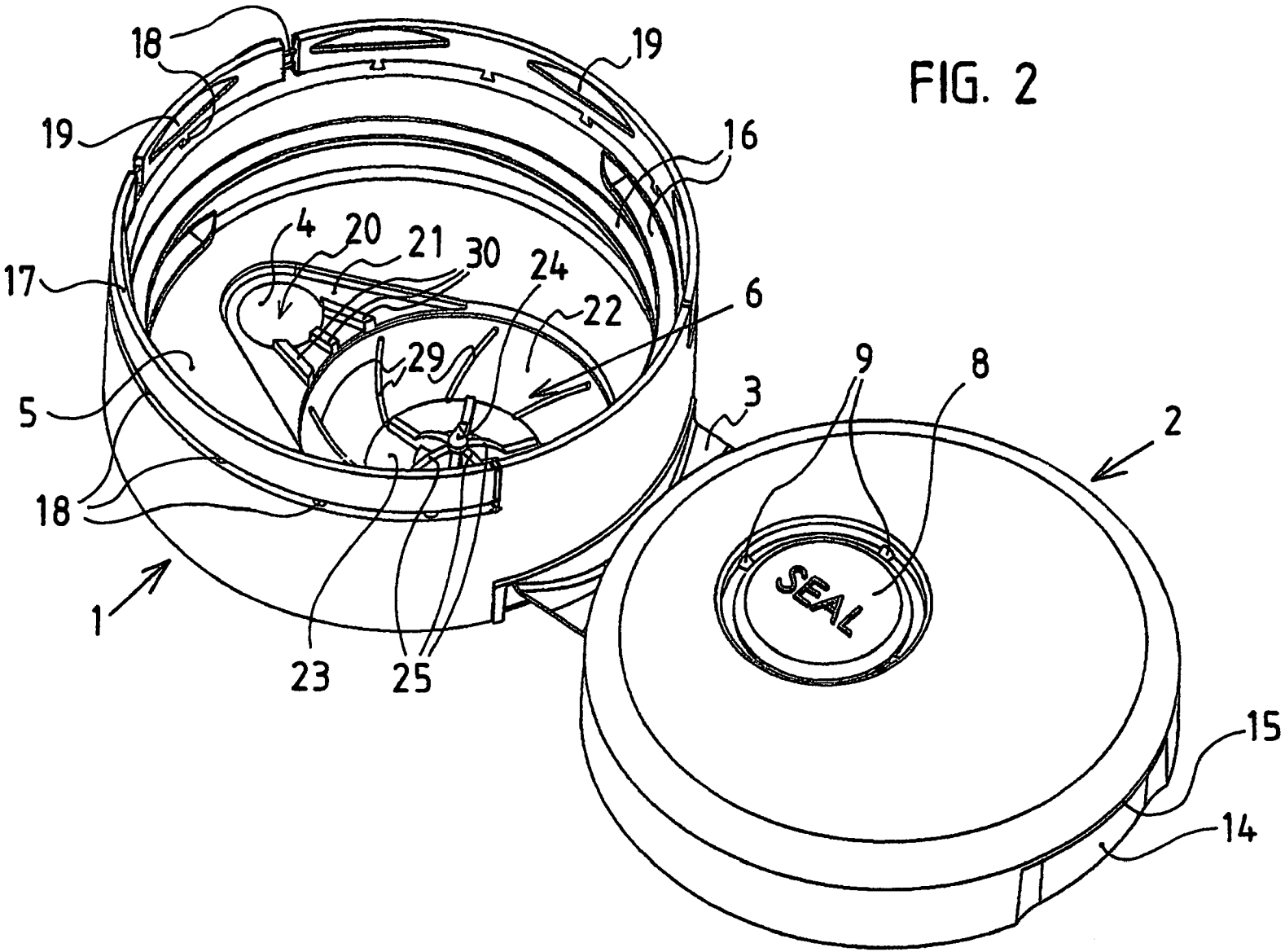
Figure 3:
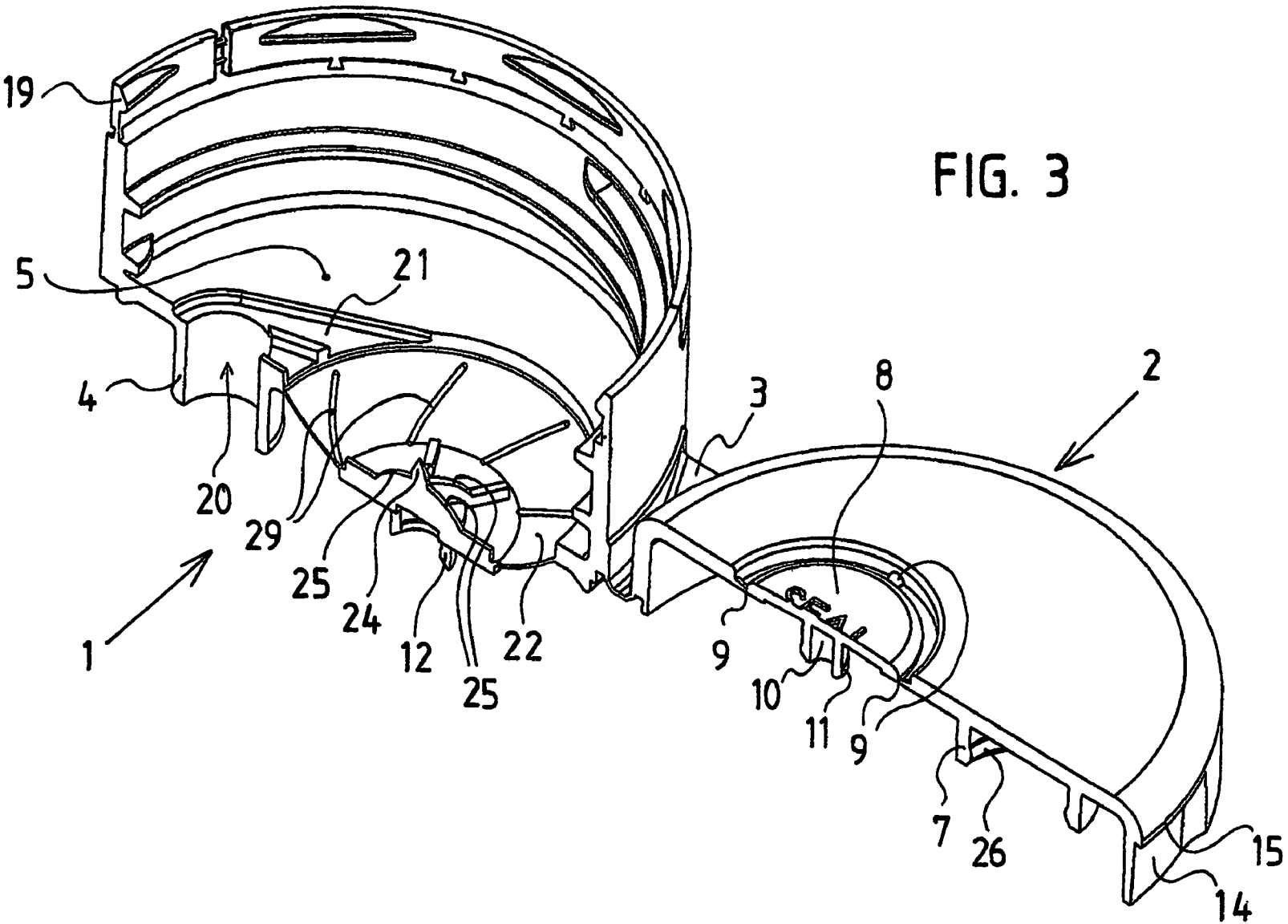
Figure 4:
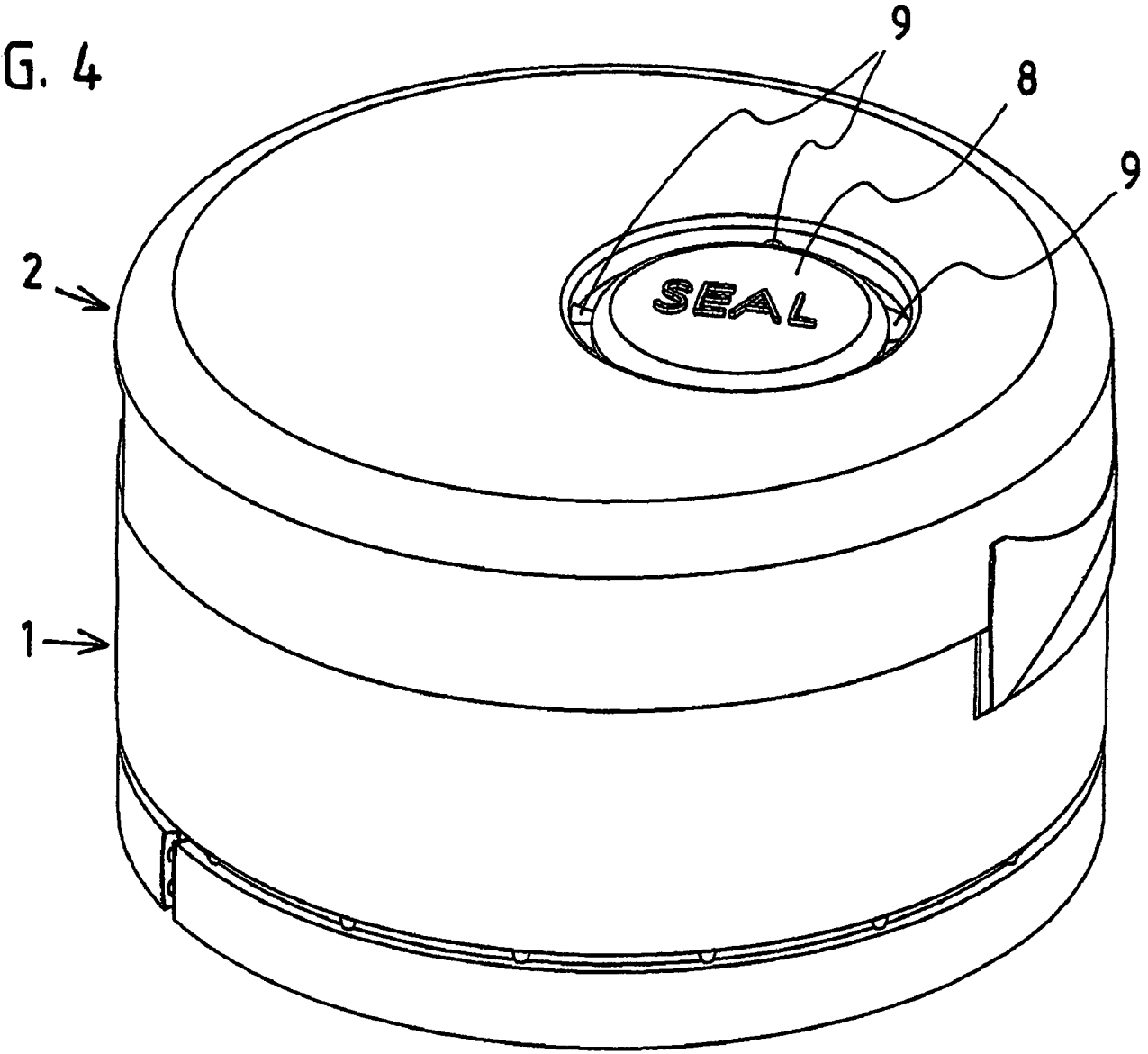
Figure 5:
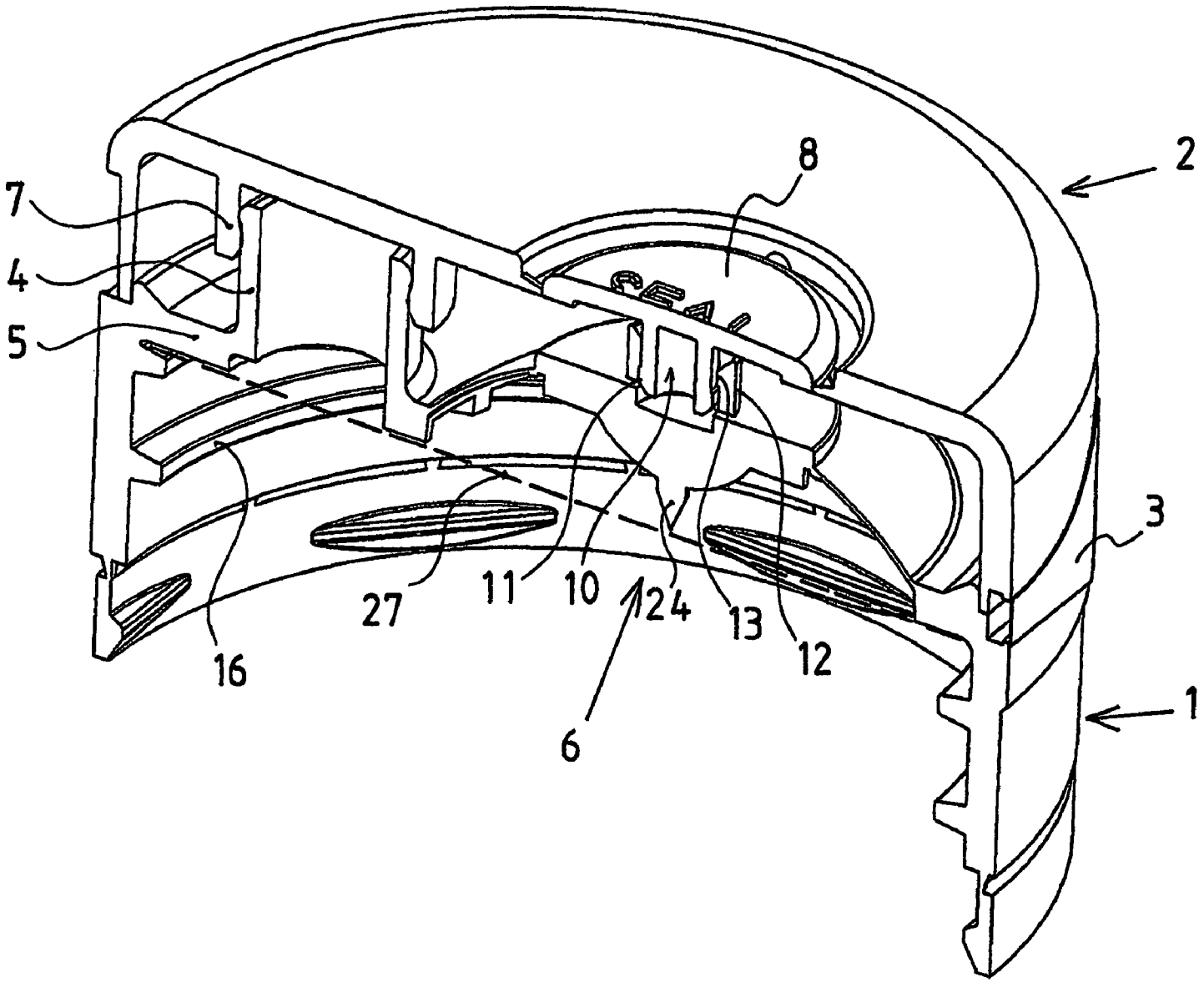
Figure 6:
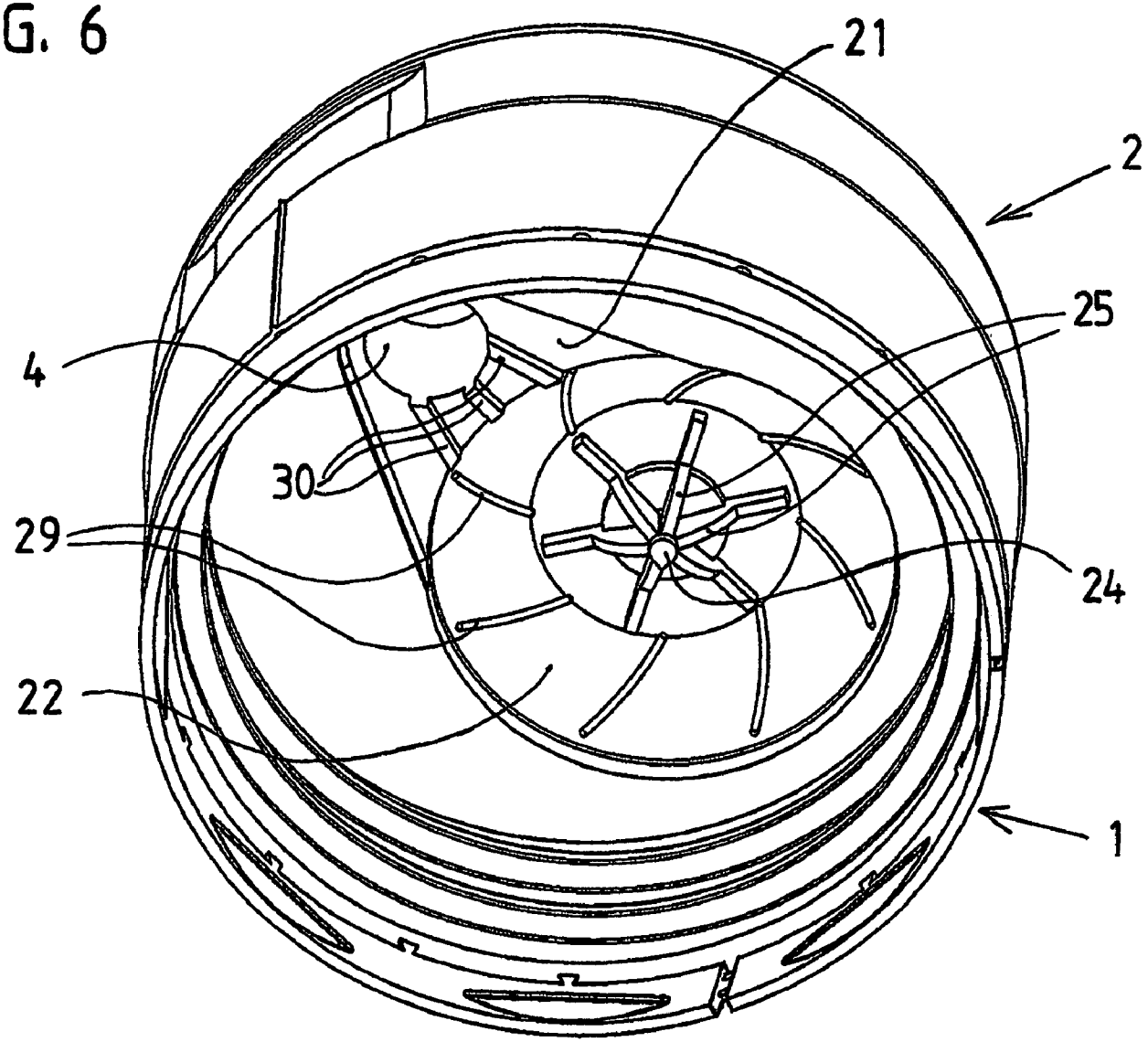
Figure 7:
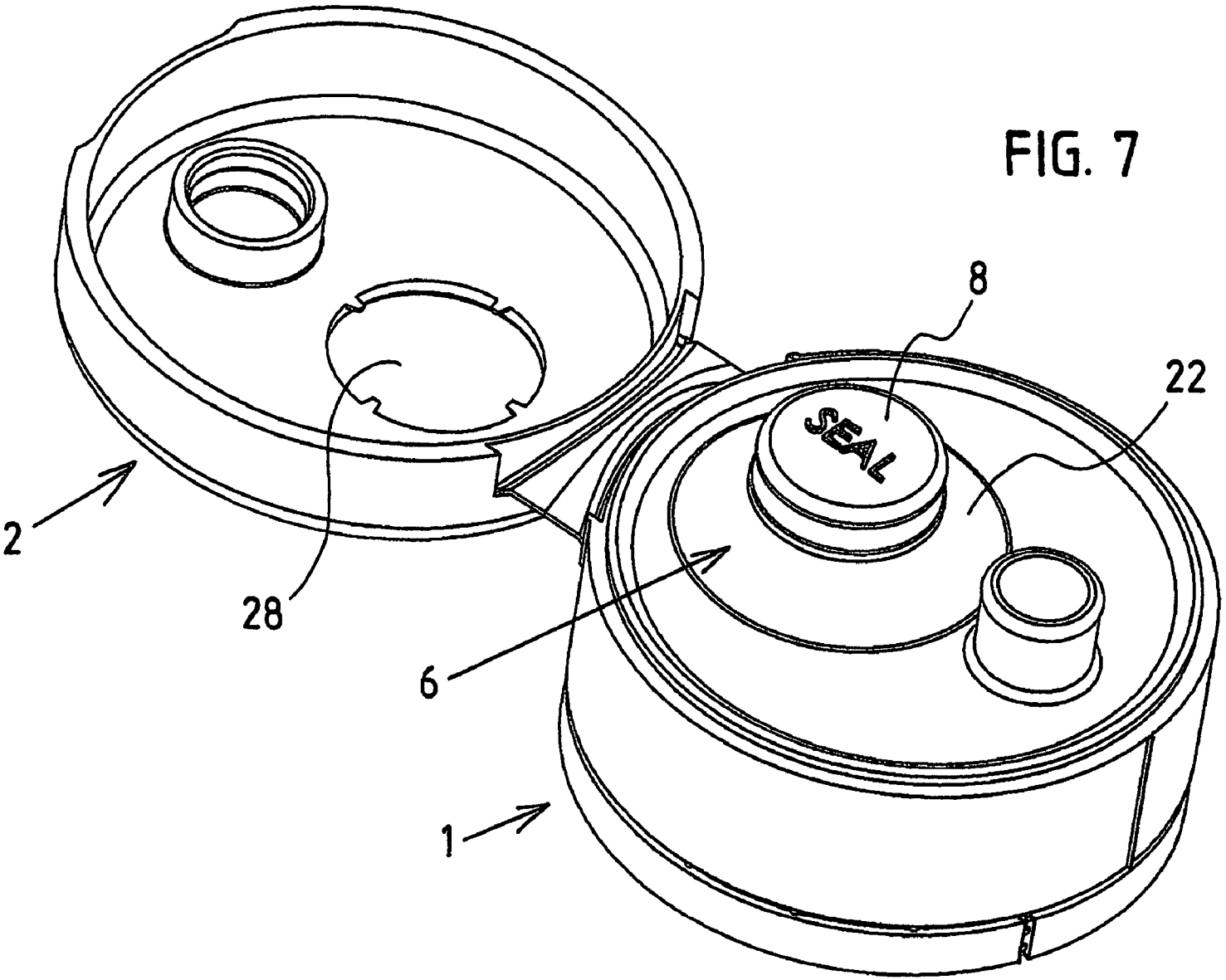
Figure 8:
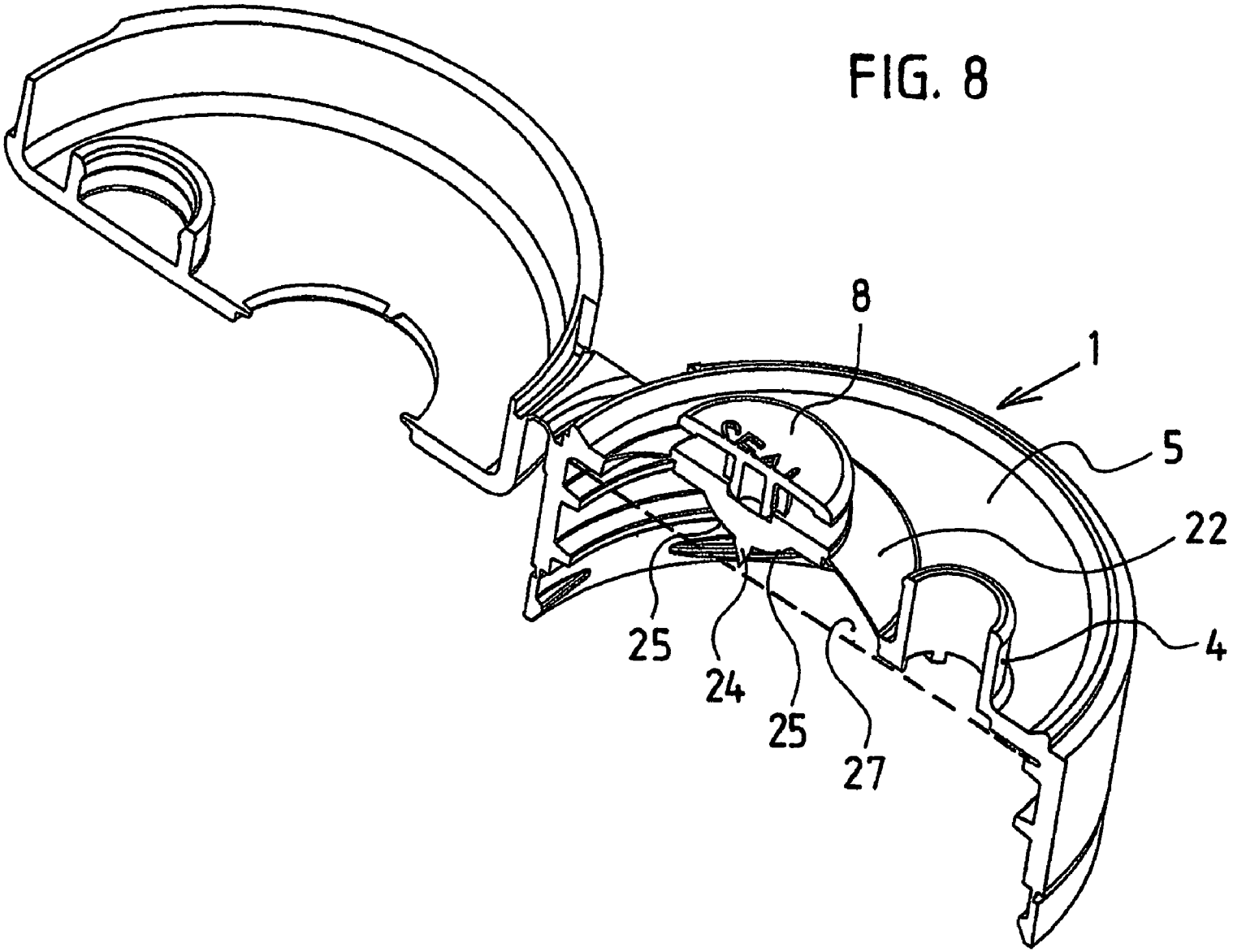
Figure 9:
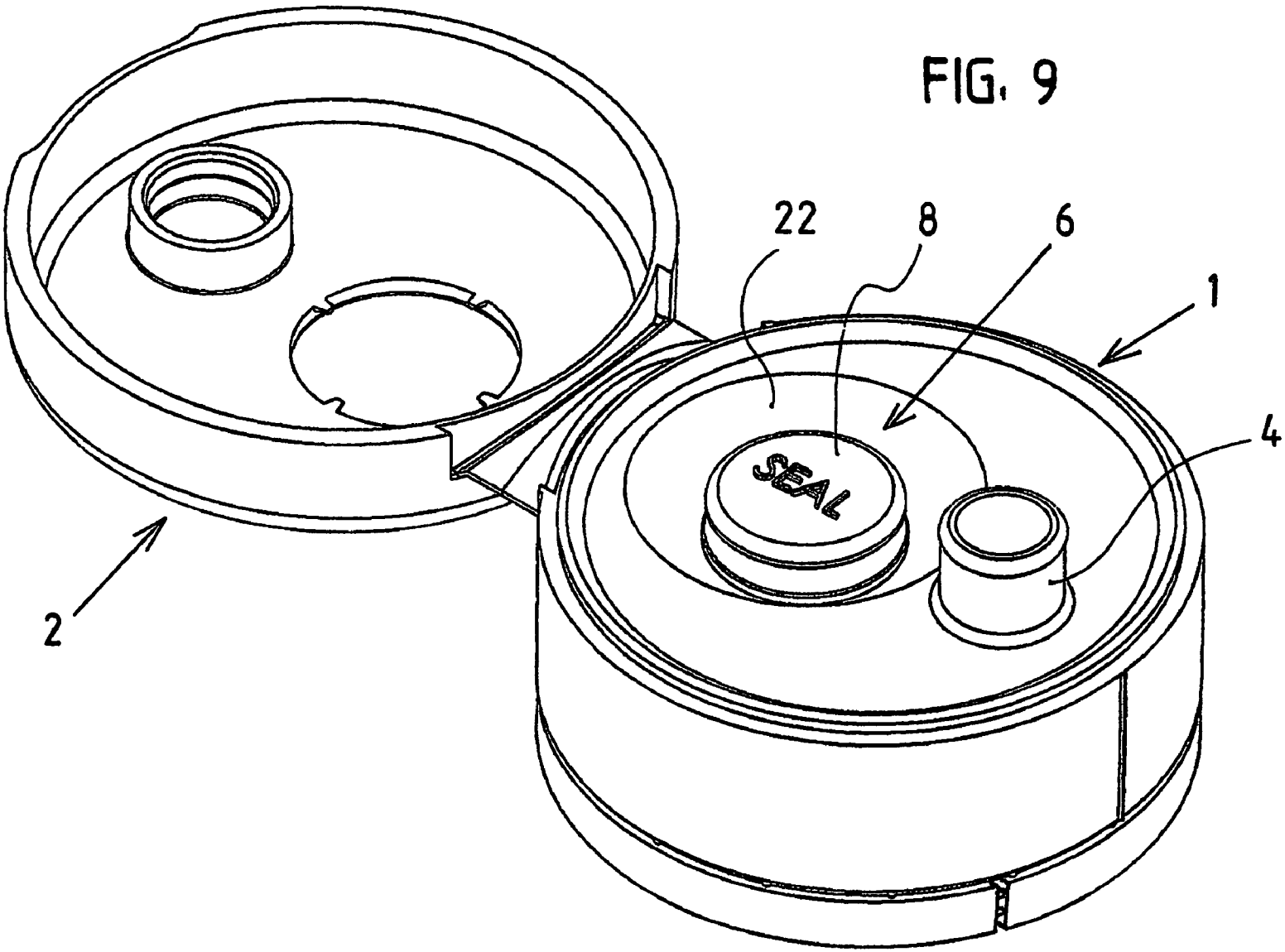

One advantageous embodiment example of this guarantee hinge closure is represented in various views in the drawings. The closure is subsequently described in detail and its function is explained by way of these representations. There are shown in:

FIG. 1 the guarantee hinge closure in the condition after its injection moulding, with a pivoted-open lid cap in a view obliquely form above, seen past the lower side of the lid cap to the upper side of the lower part;

FIG. 2 the guarantee hinge closure in the condition after its injection moulding, with a pivoted-open lid cap in a view obliquely from below, seen past the upper side of the lid cap into the lower side of the lower part;

FIG. 3 the guarantee hinge closure as shown in FIG. 2, but in a longitudinal section through its middle;

FIG. 4 the guarantee hinge closure in the condition after the first pivoting closed and closure of its lid cap, and how it is screwed into a bottle or onto a container;

FIG. 5 the guarantee hinge closure in the condition as is represented in FIG. 4, but shown in a longitudinal section through its middle;

FIG. 6 the guarantee hinge closure with a pivoted-closed and closed lid cap seen obliquely from below;

FIG. 7 the guarantee hinge closure after pivoting-open its lid cap for the first time, in a view obliquely from above, seen past the upper side of the lower part into the lower side of the lid cap, with the piercing means which has still not been used;

FIG. 8 the guarantee hinge closure in the condition as is represented in FIG. 7, but shown in a longitudinal section through its middle;

FIG. 9 the guarantee hinge closure with a pivoted-up lid cap in a view obliquely from above, seen past the upper side of the lower part into the lower side of the lid cap, however after the actuation of the piercing means has been effected.

DETAILED DESCRIPTION OF THE DRAWING FIGURES AND PREFERRED EMBODIMENTS

FIG. 1 shows the guarantee closure of plastic in the open position, as is represented directly after its injection moulding. It consists of an upper part 1 and of an associated lid cap 2 which is connected to the lower part 1 as one piece via a hinge 3. The lower part 1 forms a threaded cap with an inner thread and is envisaged to be screwed onto the threaded spout of a bottle or of a container. This cap is closed at the top by the cap lid 5 with the exception of the pour-out spout 4. As a particularity, this closure lower part 1 comprises a piercing means 6 for piecing open a sealing film which is welded onto the spout of the bottle or of the container. The construction and function of this piercing means 6 will become clear in the course of the description. Firstly it is sufficient to mention that this piercing means 6 on the outer side which is visible here forms a dome-like raised part and an arch-like outward formation and that this outward formation is designed or is deformable such that it may be pushed downwards from the position shown here and at the same time springs into the pressed-down position in which it then projects downwards as a dome-like recess or arch-like outward formation. The deformation from the initial condition shown here into the pressed-down condition is effected in an irreversible manner, which means to say that the pressed-down condition of the arch-like outward formation remains stationary. The lid cap 2 on its inner side comprises a muff 7 which is arranged an dimensioned such that on pivoting-closed the lid cap 2 onto the lower part 1, it is pushed exactly onto the pour-out spout 4 and therefore encloses this in a sealing manner. Furthermore the lid cap 2 comprises a push button 8 which is connected to the lid cap 2 via a number of material bridges 9. In the shown example it is the case of four material bridges 9 distributed over the periphery of the push button 8. The push button 8 here is seen from its lower side. It is therefore actuated from the other side. On the lower side shown here it comprises a cam 10 which projects perpendicularly from this lower side and which at its end is encompassed by a protruding bead 11. Two semicircular grip pieces 12 are integrally formed on the upper side of the piercing means 6 as counter-pieces to this cam 10. These grip pieces at their inner upper edge form an inwardly protruding bead 13. If the lid cap 2 is pivoted closed onto the lower part 1 about the hinge 3, the cam is pressed between the two grip pieces 12, by which means finally the bead 11 on the cam 10 is snapped in behind the beads 12 on the grip pieces 12. Of course it is just as possible for the grip pieces 12 to be seated on the push button and the cams 10 on the arch-like outward formation. What is essential however is that these two complementary elements may lock into one another with a tensile non-positive fit. The reason for this will become clear in the course of the description of the function of the closure.

FIG. 2 shows the guarantee hinge closure in the same condition as shown in FIG. 1, which is to say after its injection moulding, but upside down or turned over, which is to say seen obliquely from below past the upper side of the lid cap 2 into the lower side of the lower part 1. In the lid cap 2, one may recognise the push button 8 which is held in the lid 2 via four material bridges 9. On that side of the lid cap 2 lying opposite the hinge 3, this lid cap comprises a recess 14 so that a protruding edge 15 is formed above it, on which the lid cap 2 may be gripped for pivoting open. The lower part 1 is integrally formed on the other side of the hinge 3. One may see the inner thread 16 on the inner side of the threaded cap formed by this lower part 1. A strip 17 is integrally formed via a number of material bridges 18 on the lower edge of the lower part 1 which is to be seen at the top in this drawing. At the front side of the closure, thus opposite the hinge, thus strip 17 is interrupted and the two ends are connected to one another only via two small material bridges 18. Retaining elements 16 are arranged on the inner side of this strip 17, which on screwing open the guarantee hinge closure for the first time irreversibly lock in on a corresponding projection on the threaded spout of the bottle or the container. By way of this the guarantee hinge closure may now be screwed away from the threaded spouts amid the breakage of material bridges 18. On the inner side of the cap lid 5 one recognises the opening 20 of the pour-out spout 4 arranged on the other side. A recess 21 is recessed out of the cap lid 5 around this opening 20. This recess extends towards the lower side of the piercing means 6 and here comprises a few guide ribs 30 whose function will become evident later. The piercing means 6 consists of the dome-like, that is to say arch-like outward formation 22 which in the view shown here is arched downwards. In the centre of this arch-like outward formation, a piercing spike 24 is arranged projecting vertically from the inner side of the arching of this outward formation. Radial reinforcement ribs 25 are arranged for stabilising this piercing spike 24, and extend over the whole central region 23. These reinforcement ribs 25 however not only have the function of reinforcing the piercing spike 24 for piercing the sealing film, but just as well also for now keeping open the hole which has arisen by way of piercing the sealing film. Outside the central region 23 of the arch-like outward formation 22 this comprises spirally outwardly pointing stabilising ribs 29 which on the one hand reinforce the outward formation 22 and on the other hand ensure that this from the outwards directed condition shown here may be pressed in amid a springing deformation, that is to say in the direction towards the inside of the lower part 1 forming the threaded cap, so that it is finally arched towards the inside of the lower part 1. With this pressing-in of the deformation 22, the piercing spike 2 is pushed into the inside of the lower part 1 and the outwards formation springs from the concave shape shown here into a convex shape which is seen from here, and retains this. Furthermore the stabilising ribs 29 serve as flow aids on injection moulding this part.

In FIG. 3 the guarantee hinge closure is represented as in the just described FIG. 2 but in a longitudinal section through its middle. In this representation in particular one recognises the shape of the sectioned elements. Firstly the retaining elements 19 are to be mentioned which in each case form a barb. The recess 21 on the inner side of the cap lid 5 of the lower part 1 extends around the inlet opening 20 of the pour-out spout 4 and opens out into the arch-like outward formation 22 which here is outwardly arched with respect to the threaded cap which indeed is formed by the lower part 1 of the closure. On the inner side of this outward formation 22, this is provided with stabilising ribs 29 which are arranged in a spiral manner. These contribute to helping the outward formation 22 spring from the outwardly arched position shown here into a position in which it is inwardly arched. The grip pieces 12 are seated on the outer side of the arch-like outward formation 22, of which here only one is to be seen due to the section. In contrast, on the inner side, that its to say opposite the grip pieces 12, the piercing spike 24 projects into the inside of the threaded cap or of the closure lower part 1. It is secured in this vertically projecting position with a number or radial reinforcement ribs 25. The lid cap 2 which here is pivoted open by 180° from its closed position, in this view is visible from the top or from the outside. A push button 8 is formed in the plane of its lid, and this button 8 is held in the plane of the lid only via a few material bridges 9. At the bottom a cam 10 with a protruding outer edge 11 projects downwards perpendicularly to the plane of the lid. The cam 10 is designed hollow for reasons of injection moulding technology. The muff 7 which projects downwards on the lower side of the lid plane and which on its inner side along its edge forms a bead 26 is located somewhat further distanced to the hinge 3. On pivoting closed the lid cap 2 onto the lower part 1 of the closure, the muff 7 is pushed over the pour-out spout 4 is a sealing manner and the cam 10 comes to lie between the grip pieces 12, wherein its bead 11 locks in behind the beads 13 on the grip pieces 12 and thus is held in these in a firm manner.

The guarantee closure in the condition after pivoting closed and closure of its lid cap 2 for the first time is shown in FIG. 4. In this condition it is screwed onto a bottle or onto a container. In contrast to the conventional hinge closures one recognises a push button 8 in the lid plane which is held therein only via four material bridges 9.

FIG. 5 shows the guarantee closure in the condition as shown in FIG. 4 but here it is shown in a longitudinal section through its middle. In this representation one may recognise very well how the muff 7 on the inner side of the lid cap 2 is pushed over the pour-out spout 4 and how the cam 10 is locked in between the grip pieces 12. Since the piercing means 6 as a whole forms an arch-like outward formation to the top, this arch may muster the reaction force so that the grip pieces 12 resist the pressing force of the cam 10 and are merely spread slightly, so that the cam 10 with its edge bead 11 locks in behind its beads 13 and this is held thereon with tension. In the representation shown here, one may also see that the tip of the piercing spike 24 only reaches up to the lower side of the lid plane of the threaded cap 1 but does not go below this. A sealing film 27 which is welded or bonded onto the spout of a bottle or a container here is drawn in a dashed manner and runs exactly below this lid plane and thus firstly remains undamaged by the piercing cutter 24.

FIG. 6 shows the guarantee hinge closure with a lid cap 2 which is pivoted closed and closed, seen obliquely from below. One recognises the piercing spike 24 which is arranged centrally on the piercing means, with its reinforcing ribs 25 on the underside of the arch-like outward deformation 22 with its stabilisation ribs 29, which as a whole form the piercing means 6.

As is shown in FIG. 7 the guarantee hinge closure is presented after pivoting open the lid cap 2 for the first time. Since the push button 8 on pivoting closed the lid cap for the first time locks into the grip pieces with its downwardly projecting cams, it is firmly held on the lower part 1 of the closure. The renewed pivoting open of the lid cap 2 is only possible with the breakage of the material bridges 9 with which the push button 8 is held on the lid cap 2 in the initial position. The push button 8 therefore remains on the lower part 1 and then a hole 28 gapes in the pivoted-open lid cap 2 which leaves behind the push button 8 which is previously arranged therein. The push button 8 is now seated on the arch-like outward formation 22 of the piercing means 6. The material bridges 9 thus act as guarantee elements for ensuring a guarantee for opening for the first time. As soon as the lid cap 2 is flipped open for the first time, these material bridges are destroyed and one immediately recognises from the closure that this is no longer undamaged.

FIG. 8 shows exactly this situation after pivoting open the lid cap 2 for the first time, but in a longitudinal section through the middle of the guarantee hinge closure. The sealing film 27 is indicated running below the piercing spike 24, which is cut or pierced for pouring out the contents. This now is effected in that in the open position of the lid cap 2 which is shown here, one presses on to the push button 8 with the finger. By way of this, the dome-like or arch-like like outward formation 22 is deformed and the piercing spike 24 is pushed downwards and pierces the sealing film 27 which is tensioned thereunder. The outward formation 22 finally springs onto the lower side of the cap lid 5 of the threaded cap 1 which forms the closure lower part 1. Accordingly then a downwardly arched outward formation 22 is formed and the piercing spike 24 opens the sealing film 27. The through-flow open which has arisen is larger that the through-flow cross section of the pour-out spout 4 and from now on is held open by the reinforcement ribs 25.

In FIG. 9 it is evident how the closure lower part 1 looks seen from above after pressing down the push button 8. The whole push button 8 lies on a level which is a few mm deeper and the arch-like outward formation 22 is sprung into a position in which seen from above, it is funnel shaped. At the same time the piercing spike is pierced into the sealing film and it presses this, downwards together with its reinforcement ribs and the reinforcement ribs keep a through-flow opening in the sealing film open.

The guarantee hinge closure is now ready for pouring out the contents. The bottle or the container is brought into the pour-out position and the contents then flow through the pierced and tom-open through-flow opening within the recess 21 which may be seen in FIG. 6, and within this between the guide ribs 30 to the pour-out spout 4 and through this to the outside. For the fluid then which flows out, a clearly defined channel is formed by the guide ribs 30, through which the fluid, after having gone through the opening in the sealing film 27, is led to the pour-out spout 4 and flows through this to the outside. After use, the lid cap 2 whilst pivoting closed is again flipped onto the lower part 1, whereupon it sealing closes the pour-out spout 4 with its muff 7. In this closed position the fluid which is located within and outside the pour-out spout 4 is excluded from air and thus may not become crusty.

This guarantee hinge closure thus has the advantage that the sealing film may be opened with a simple finger pressure on a push button 8. The closure need therefore not be firstly screwed away from the bottle or container, whereupon the sealing film may be removed. The closure is therefore considerably more user-friendly. It is also no longer necessary to pierce open or press through the sealing film with the help of a piercing tool through the pour-out spout, which in any case does not lead to a clean flow opening. The closure with the push button arranged in the lid cap via material bridges includes an integrity guarantee means which render the provision of additional adhesive strips or other types of seals unnecessary. Despite this, the closure may be injection moulded as a single-piece part in one go and thus is hardly more expensive than a conventional hinge closure.

LIST OF REFERENCE NUMERALS

1 closure lower part
2 lid cap
3 hinge
4 pour-out spout
5 cap lid on the closure lower part
6 piercing means
7 muff on the inner side of the lid cap 2
8 push button
9 material bridges for the push button
10 cams on the lower side of the push button
11 protruding bead on the cam
12 grip pieces on the outside on the arch-like outward formation
13 inner bead on the darning pieces 12
14 recess in the lid cap edge
15 edge above the recess 14
16 inner thread on the closure part 1
17 strip on the lower edge of the closure part 1
18 material bridges for the strip 17
19 retaining means on the strip 17
20 opening/orifice of the pour-out spout
21 recess in the cap lid 5 of the lower part 1
22 dome-like, arch-like outward formation
23 central region of the outward formation
24 piercing spike
25 reinforcing ribs for the piercing spike
26 bead on the inner side of the muff 7
27 sealing film on the bottles or container opening
28 hole in the lid cap 2 by the absence of this push button
29 spiral stabilising ribs on the outward formation 22
30 guide ribs in the recess

The invention claimed is:

1. A hinge closure providing an indication of initial opening of film-sealed bottles and containers having flowable contents, comprising:

a closure lower part having an inner thread for a screwable connection with a threading of a pour-out spout of a bottle or container;

a cap lid closable with said closure lower part on an upper side of said closure lower part, said cap lid closing said closure lower part with an exception for the pour-out spout of less than half a diameter of said inner thread of said cap lid;

said cap lid integrally formed in a hinged manner on said closure lower part with a pipe collar on an inner side of said cap lid for encompassing the pour-out spout in a position when said cap lid is closed with said inner thread of said closure lower part; and piercing means for said cap lid of said closure lower part outside of the pour-out spout, said piercing means including a piercing spike arranged centrally on said piercing means, said piercing means being pressable from an upper, initial position amid a springing deformation into a lower end position, said cap lid including a push button for actuating said piercing means with said push button being connected to said piercing means via material bridges acting as break-off locations.

2. The hinge closure providing an indication of initial opening of film-sealed bottles and containers having flowable contents according to claim 1, wherein said push button of said cap lid including a downwardly projecting cam and a protruding edge bead with said push button being integrated into said cap lip and held thereon via said material bridges, said downwardly projecting cam, upon pivoting closed said cap lip on said closure lower part for an initial time, irreversibly locks behinds beads on grip pierces on an arch-shaped outward formation with said cap lid belonging to said closure lower part in a hinged manner and, thereafter, is pivotably openable only amid breakage of said material bridges acting as integrity guarantee means.

3. The hinge closure providing an indication of initial opening of film-sealed bottles and containers having flowable contents according to claim 1, wherein said piercing means includes an arch-shaped outward formation in said cap lid projecting outwardly on said closure lower part, in an initial position, and via a spring deformation is pressable into an inwardly projecting position.

4. The hinge closure providing an indication of initial opening of film-sealed bottles and containers having flowable contents according to claim 1, wherein said piercing means includes an arch-shaped outward formation in said cap lid projecting upwardly on said closure lower part, in an initial position, and via a spring deformation is pressable in a downwardly projecting position.

5. The hinge closure providing an indication of initial opening of film-sealed bottles and containers having flowable contents according to claim 1, wherein said piercing means includes an arch-shaped outward formation in said cap lid projecting outwardly on said closure lower part with said piercing spike on a lower side of said arch-shaped outward formation, for retaining in an open mode a hole pierced by said piercing spike, being reinforced via radial ribs.

6. The hinge closure providing an indication of initial opening of film-sealed bottles and containers having flowable contents according to claim 1, wherein said piercing means includes an arch-shaped outward formation with spirally-arranged stabilizing ribs on a lower side of said arch-shaped outward formation for acting as a flow aid upon injection molding said arch-shaped outward formation.

7. The hinge closure providing an indication of initial opening of film-sealed bottles and containers having fiowable contents according to claim 1, wherein said piercing means includes an arch-shaped outward formation with said arch-shaped outward formation opening in said cap lid into a recess that is recessed from said cap lid and which opens into an opening of the pour-out spout.

* * * * *